United States Patent [19]

Fukuoka

[11] 4,417,407

[45] Nov. 29, 1983

[54] FOOTWEAR

[75] Inventor: Sadao Fukuoka, Tokushima, Japan

[73] Assignee: Fukuoka Kagaku Kogyo, Tokushima, Japan

[21] Appl. No.: 356,953

[22] Filed: Mar. 11, 1982

[30] Foreign Application Priority Data

| | | | |
|---|---|---|---|
| Mar. 31, 1981 | [JP] | Japan | 51-45751[U] |
| Mar. 31, 1981 | [JP] | Japan | 51-45752[U] |
| Jun. 10, 1981 | [JP] | Japan | 51-84180[U] |

[51] Int. Cl.[3] ..... A43B 7/06; A43B 7/08; A43B 13/20

[52] U.S. Cl. ..... 36/3 B; 36/29; 36/3 R

[58] Field of Search ..... 36/3 R, 3 B, 3 A, 29

[56] References Cited

U.S. PATENT DOCUMENTS

| | | | |
|---|---|---|---|
| 890,966 | 6/1908 | Critz, Jr. | 36/3 R |
| 1,168,166 | 1/1916 | Cook | 36/3 A |
| 1,527,371 | 2/1925 | Mullarky | 36/3 R |
| 1,938,393 | 12/1933 | Kelley | 36/3 R |
| 2,751,692 | 6/1956 | Cortina | 36/3 R |
| 3,273,265 | 9/1966 | Reinert et al. | 36/3 R |
| 4,364,186 | 12/1982 | Fukuoka | 36/29 |

FOREIGN PATENT DOCUMENTS

| | | | |
|---|---|---|---|
| 116667 | 2/1900 | Fed. Rep. of Germany | 36/3 R |

*Primary Examiner*—Werner H. Schroeder
*Assistant Examiner*—Steven N. Meyers
*Attorney, Agent, or Firm*—Edward F. Levy

[57] ABSTRACT

An article of footwear such as a shoe includes a deformable inner sole, an outer sole, as well as a resilient pumping member and resilient supporting member disposed in a hollow portion defined between the inner and outer soles. The pumping member, comprising a hollow body, is penetrated by a plurality of air-intake holes for communicating the pump interior with the hollow portion, and is provided with a tube communicating with the rear of the shoe, and the inner sole has ventilating holes for communicating the hollow portion with the interior of the shoe. The application and removal of the wearer's weight with each step repeatedly deforms the inner sole which in turn causes an exchange of air between the hollow portion and the shoe interior through the ventilating holes, as well as the compression and relaxation of the pump member to expel air, drawn into the pump member from the hollow portion through the air-intake holes, toward the rear of the shoe. Thus the shoe is ventilated by air layers located above and below the inner sole.

14 Claims, 14 Drawing Figures

FOOTWEAR

BACKGROUND OF THE INVENTION

This invention relates to an article of footwear, such as a shoe, which is so adapted as to permit ventilation of the interior of the footwear.

In the art of ventilating the interior of an article of footwear with air it is conventional practice to form the outer sole of the footwear with air compartments each of which comprises a hollow projection, or to furnish the entire outer sole with flexibility and form air compartments within the outer sole. When the weight of the wearer is applied to the shoe or other footwear of this type, the air compartments are compressed so that the air enclosed within the compartments is forced out into the shoe through the inner sole to circulate the air within the shoe. With the conventional shoe of this type ventilation is achieved at the rear of the shoe through the gap between the shoe and the wearer's ankle, but sufficient ventilation is difficult to achieve at the front or toe portion of the shoe. The result is that moist air collects and stagnates in the marginal areas at the front of the shoe, causing the wearer's foot to become hot and stuffy.

SUMMARY OF THE INVENTION

The present invention has been devised in view of the foregoing disadvantage encountered in the conventional footwear designed for breathability.

Accordingly, the first object of the present invention is to provide a shoe which is comfortable to wear and which promotes the health and hygiene of the wearer's feet by achieving ventilation through a dual system composed of air layers disposed above and below the inner sole.

The second object of the present invention is to provide a shoe which removes moist air from the interior of the shoe to promote the health of the wearer's feet by achieving ventilation of the marginal area at the front of the shoe.

The third object of the present invention is to provide a shoe which is capable of achieving a sufficient ventilating effect by means of a pump.

The fourth object of the present invention is to provide a shoe within which the movement and diffusion of air is promoted to prevent the accumulation of stagnant air within the shoe.

Another object of the present invention is to provide a shoe the interior of which is ventilated by utilizing a ventilating function designed into the shoe interior, without causing local deformation of the outer sole.

These and other objects and features of the present invention will be apparent from the following description taken in conjunction with the accompanying drawings, in which like reference characters designate the same or similar parts throughout the figures thereof.

DESCRIPTION OF THE PREFERRED EMBODIMENT

Figure 3:
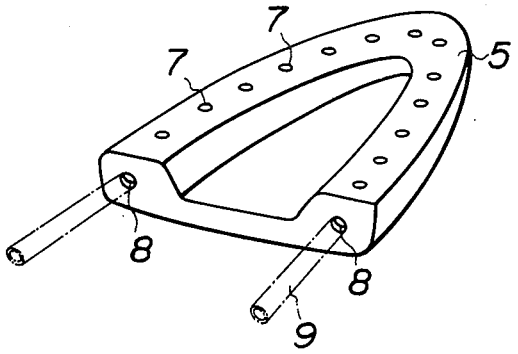
FIG. 3 is a perspective view showing an example of a pump used in the present invention.

Referring now to FIGS. 1 through 4, a shoe 1 constructed in accordance with the present invention includes an outer sole 2 which has an erect portion 3 of a prescribed height formed on the peripheral portion thereof, as well as a flange portion 4 formed at the upper part of the erect portion 3. The outer sole 2 also includes an arch portion 2'. The outer sole 2 consists of a resilient material such as vinyl chloride, synthetic rubber, urethane or the like. A pump 5, having a U-shaped configuration which conforms to the shape of the forward portion of the outer sole 2, is fixedly received in a hollow portion C which is formed inside the erect portion 3 of the outer sole. Specifically, the pump 5 is arranged along the outer circumferential portion of the hollow portion C and has an internally formed air compartment 6, such arrangement being shown more clearly in FIGS. 2 and 3. The air compartment 6 defined within the pump 5 is generally tubular in shape. The air compartment 6 is provided with a plurality of air-intake holes 7 along the entire upper portion thereof, and with air discharge holes 8 formed in the rear portion thereof, as shown in FIG. 3. The pump 5 consists of the same class of materials used to fabricate the outer sole 2. A ventilating tube 9 is connected to each of the air discharge holes 8 in the pump 5 and extends to a point adjacent the arch portion 2' of the outer sole 2. According to the structure of the human foot, the clearance between the shoe and the foot inserted into the shoe is greatest in the vicinity of the arch portion 2'. Accordingly, the ventilating effect can be greatly enhanced by using a mesh M to form a portion of the upper 10 above the arch portion 2', enabling the air within the shoe to be exchanged with the air outside.

Figure 1:
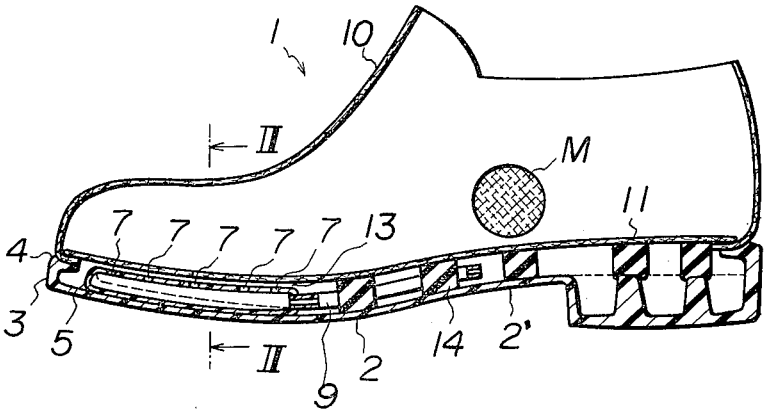
FIG. 1 is a longitudinal sectional view illustrating a typical embodiment of the present invention.
Figure 2:
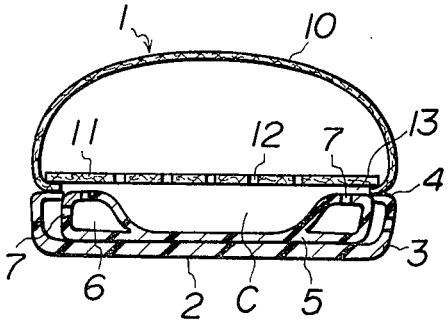
FIG. 2 is a sectional view taken along the line II—II of FIG. 1.
Figure 4:
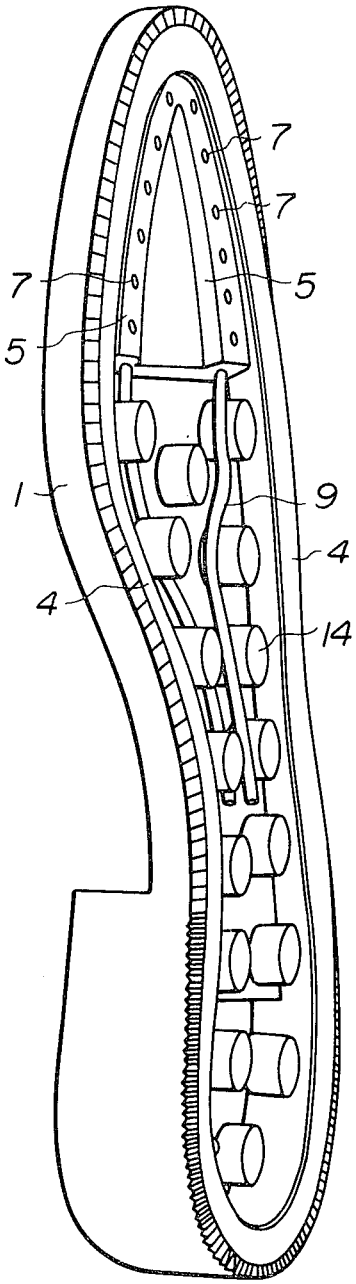
FIG. 4 is a perspective view showing the structure of an outer sole, particularly the details of a pump installed within the outer sole, in an embodiment of the present invention.

The upper 10 mentioned above has its lower edge inseparably adhered to the upper surface of the flange portion 4 of the outer sole 2. An inner sole 11 is affixed to the lower edge of the upper 10 at the flange portion 4, and is provided over substantially its entire area with a multiplicity of ventilating holes 12, these holes 12 being absent only from that portion of the inner sole 11 located over the air compartment 6 of the pump 5. Supporting bodies 14, consisting of a resilient material, are disposed between the outer sole 2 and inner sole 11, as best seen in FIGS. 1 and 4. In the above arrangement the pump 5 received in the hollow portion C of the outer sole 2 has such a height that delimits a small gap 13 between the pump and the inner sole 11, as depicted in FIG. 1.

When the weight of the wearer is applied to the inventive shoe during use, the pump 5 is pressed between the outer sole 2 and inner sole 11. Consequently, the air enclosed within the pump 5 is forced into the ventilating tubes 9 from the air discharge holes 8 and is expelled into the rear portion of the shoe, particularly the area where the largest clearance exists between the wearer's foot and the shoe, namely the arch portion 2'. The air expelled from the ventilating tubes 9 enters the interior of the shoe 1 from the ventilating holes 12 in the inner sole 11 and then exits from the shoe, particularly by passing through the mesh portion M. Meanwhile, the resilient supporting bodies 14 are likewise pressed between the outer sole 2 and inner sole 11 owing to the weight of the wearer, allowing compression of the hollow portion C between the outer and inner soles 2, 11. Air which has accumulated in the hollow portion C is thus forced into the shoe through the ventilating holes 12. At the same time, the inner sole 11 is deformed downwardly conjointly with the deformation of the supporting bodies 14 and pump 5, thereby widening the clearance between the wearer's foot and the shoe, particularly the upper 10. This allows fresh external air to flow into such clearance through the gap surrounding the wearer's ankle, so that the air within the shoe is constantly circulated and exchanged with the outside air.

As the wearer continues to walk and the shoe is raised from the ground, the wearer's weight is removed from the shoe so that the resilient supporting bodies 14 and pump 5 relax back to their original shapes. As they are doing so air is drawn into the hollow portion C through the ventilating holes 12, and then into the air compartment 6 through the air-intake holes 7. Since the clearance that had been formed between the foot and shoe vanishes at such time, the air which as been expelled into the shoe upon contact with the ground is forced out of the shoe. Thus, fresh air which is introduced into the shoe from the outside by the deformation of the inner sole 11 is partially circulated through the interior of the shoe and partially through the space delimited between the inner sole 11 and outer sole 2 as the shoe repeatedly makes contact with the ground, thereby defining a dual circulatory system. Ventilation thus takes place with high efficiency owing to such dual circulatory action in cooperation with the intake and discharge of air at the portion of shoe which corresponds to the wearer's ankle.

Figure 5:
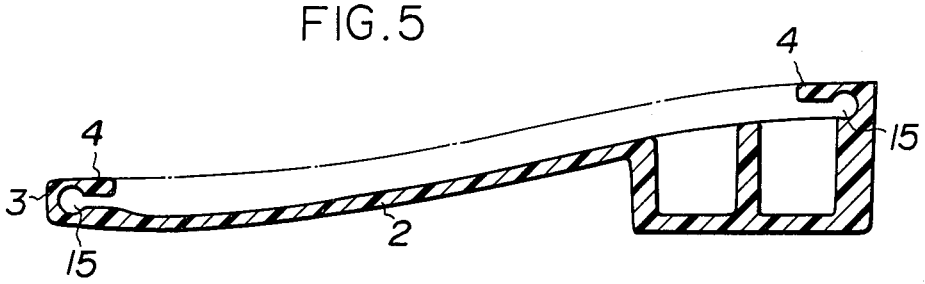
FIG. 5 is a sectional view illustrating another example of an outer sole.

FIG. 5 is a sectional view showing another example of the outer sole 2. Here a groove 15 is formed between the erect portion 3 and the flange portion 4. The inner sole 11 is carried on the flange portion 14, as described above. In the present arrangement, the groove 15 facilitates the deformation of the erect portion 3 of the outer sole 2 when weight is applied to the shoe. This makes it possible to achieve the movement of a greater quantity of air.

Figure 6:
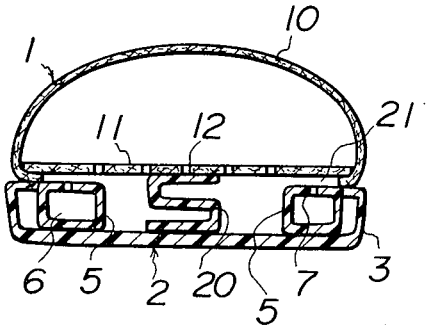
FIG. 6 is a sectional view, similar to that of FIG. 2, illustrating another embodiment of the present invention.
Figure 7:
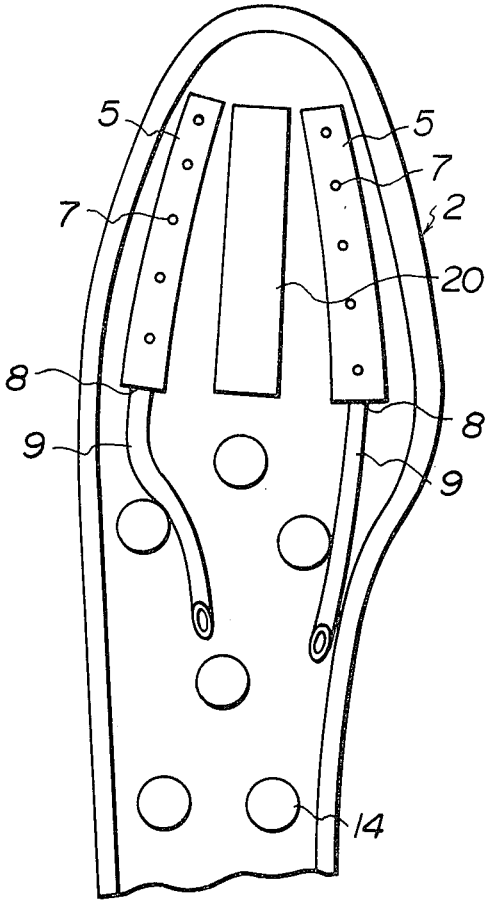
FIG. 7 is a plan view illustrating in detail the arrangement of a pump and supporting bodies installed in the outer sole of FIG. 6.

FIG. 6 is a transverse sectional view illustrating another embodiment of the present invention. The shoe shown in FIG. 6 is provided with a member 20, having a substantially S-shaped cross-section and a length equal to that of the pump 5, for supporting the inner sole 11 on the outer sole 2. The supporting member 20 thus assists in restoring the pump 5 when the weight is removed from the shoe, and precludes the formation of a permanent recess in the inner sole 11 that might be expected to occur after the shoe has been used for an extended period of time. In addition, the height of the supporting member 20 is so selected as to cause the formation of a gap 21 between the pump 5 and the inner sole 11 following the complete restoration of the pump. When the pump 5 relaxes to assume its original shape, therefore, a large quantity of air from the hollow portion C is drawn into the air compartment 6 through the air-intake holes 7. In other words, extremely effective ventilation is achieved owing to the movement of a large quantity of air from the marginal region of the hollow portion C. FIG. 7 is a plan view showing the pump 5 and supporting member 20 in greater detail. The supporting member 20 in this arrangement extends longitudinally of the shoe approximately midway between the pumps 5, one disposed on each side of the shoe.

Figure 8:
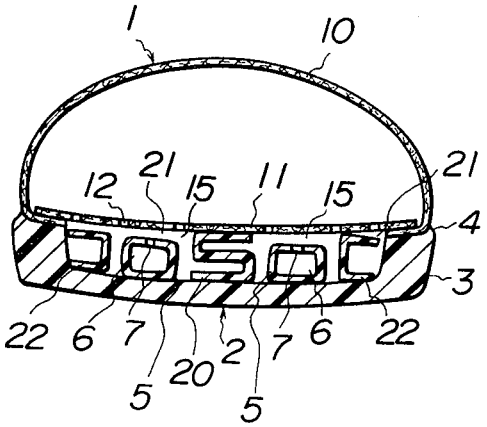
FIG. 8 is a sectional view, similar to that of FIG. 6, illustrating another embodiment of the present invention.
Figure 9:
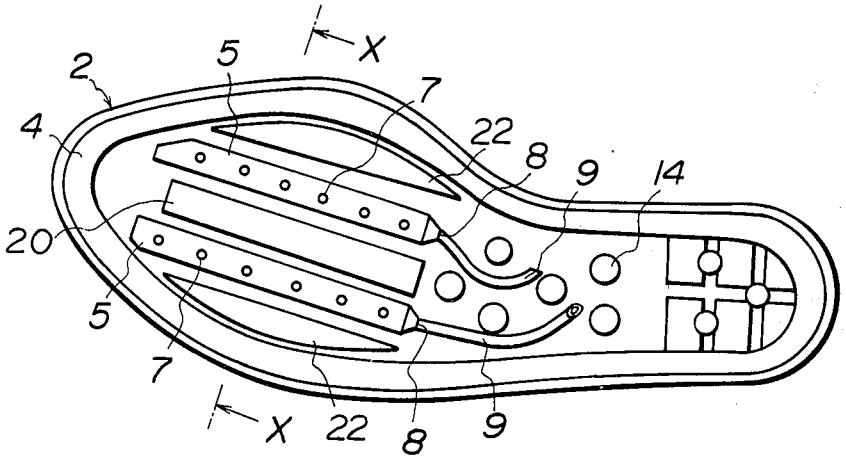
FIG. 9 is a plan view of the shoe having the structure shown in FIG. 8 with the inner sole removed to illustrate the internal arrangement of the outer sole.
Figure 10:
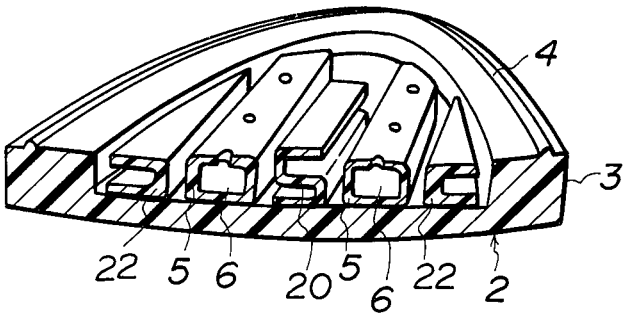
FIG. 10 is a sectional view taken along the line X—X of FIG. 9.

Another embodiment of the present invention is shown in FIGS. 8, 9 and 10. In this embodiment the shoe 1 includes the supporting member 20 disposed longitudinally of the shoe at the forward part thereof in the hollow portion between the outer sole 3 and inner sole 11 along the center line of said hollow portion, the pumps 5, 5 arranged on each side of the supporting member 20, and second supporting members 22, 22 disposed in the space between the outer and inner soles 2, 11 along the marginal areas of the shoe and substantially parallel to the pumps 5, 5. Each second supporting member 22 has an approximately C-shaped cross-section, as illustrated in FIG. 8, and is operable to disperse the air toward the erect portion 3 of the outer sole 2 upon being deformed by the weight of the wearer. Thus, when the wearer's weight is applied to the inner sole 11, the pumps 5, 5 are compressed and the air enclosed within them is expelled toward the rear of the shoe via the tubes 9, as described above. At the same time, however, in accordance with this embodiment of the invention, the second supporting members 22 are deformed to disperse the air within the hollow portion C toward the erect portion 3 so that the air is circulated throughout the hollow portion to fully prevent the accumulation of moist, stagnant air. Furthermore, the supporting members 22 function also to support the inner sole 11 along the erect portion 3 and flange 4, thereby preventing permanent deformation of the inner sole 11 while maintaining the shoe in a comfortable condition for wearing. The centrally located supporting member 20, as shown most clearly in FIGS. 9 and 10, causes a gap 21 of prescribed dimensions to be formed between the inner sole 11 and pumps 5 when the pumps have relaxed fully to their original shape. Consequently, the air drawn into and expelled from the pumps 5 with every step is approximately equivalent to the volume of the pumps.

Figure 11:
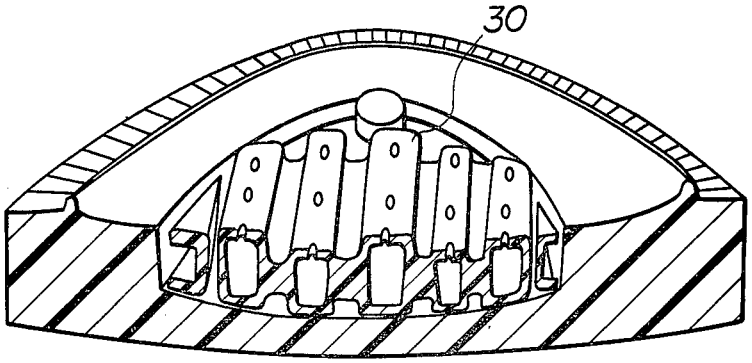
FIG. 11 is a perspective view, from which portions have been deleted, illustrating another arrangement of the pump and supporting bodies.
Figure 12:
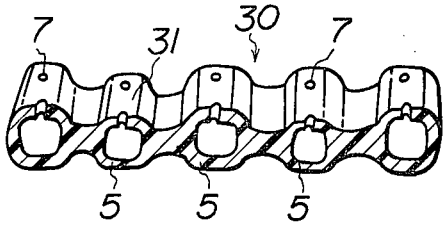
FIG. 12 is a perspective view, from which portions have been deleted, illustrating yet another example of the pump and supporting bodies shown in FIG. 11.

FIGS. 11 and 12 illustrate alternative examples of the pumps employed in the present invention. In the embodiments described hereinabove, the pumps are discrete members manufactured independently of each other. In the arrangement of FIG. 11, however, a plurality of pumps 5 are molded into a unitary body to facilitate the installation of the pumps into the hollow portion of the shoe between the inner and outer soles. Specifically, a single composite pump unit 30 can be prepared to fit two or three different shoe sizes. In this case the pump unit 30 preferably is formed to include a flat portion 31 on the surface thereof that contacts the inner sole, as shown in FIG. 12, so that the air-intake holes 7 will be completely closed when said surface contacts the inner sole. Furthermore, as in the foregoing embodiments, the individual pumps 5 that constitute the pump unit 30 can be formed to have the same height, as in the embodiment of FIG. 11. In another arrangement, the centrally located pump can be provided with a height which is greater than that of the other pumps. Grooves are formed between adjacent pumps 5, as shown in FIGS. 11 and 12, and play an important role in facilitating the circulation of air within the hollow portion C.

Figure 13:
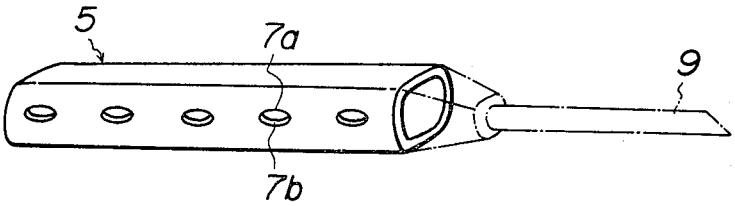
FIG. 13 is a perspective view, from which portions have been deleted, illustrating a further example of a pump used in the present invention.

FIG. 13 illustrates yet another example of a pump used in the present invention. In this arrangement the side walls of the pumps 5 are provided with a plurality of longitudinally extending holes 7' along the length of the pump. The holes 7', examples of which are shown in FIG. 13, may be circular or elongated in the longitudinal direction, such as the rhomboid, elliptical on chevron-shaped holes illustrated in the drawing. As in the embodiments described above, the application of weight to the pump 5 shown in FIG. 13 causes deformation of the pump, this in turn causing closure of the holes 7' owing to the abutting contact between the upper and lower edges *7a, 7b* of the holes as the weight is applied. With deformation, the air enclosed within the pump is fed to the arch portion at the rear of the shoe through the ventilation tube 9. Providing the holes 7' in the side walls of the pump 5 rather than along the upper portion thereof permits the ventilating holes 12 to be formed in the inner sole 11 in a random manner, and in a greater quantity. In consequence, the interior of the shoe communicates with the hollow portion C between the outer and inner soles to a greater degree for greater circulation of air. The area of the side wall of pump 5 is greater than the area of the upper portion thereof that comes into contact with the inner sole 11, and the side walls may have a multiplicity of the holes 7' formed therein at a random distribution. Such an arrangement will increase the quantity of air drawn in from the hollow portion C through the holes 7', making it possible to increase the circulation of air to mare effectively achieve the object of the invention.

Figure 14:
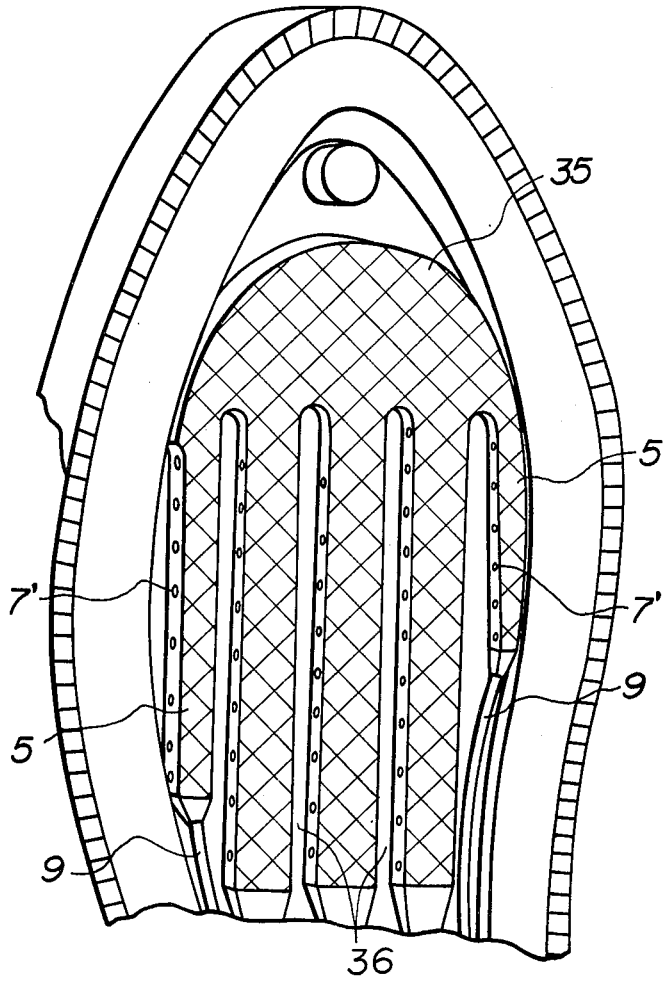
FIG. 14 is a perspective view illustrating the overall configuration of the pump shown in FIG. 13, as well as its arrangement in the shoe.

The pump 5 shown in FIG. 13 is manufactured of a resilient material such as synthetic rubber, natural rubber or vinyl chloride. As shown in FIG. 14, a plurality of the pumps 5 are interconnected into a unitary body by a connecting member 35, with grooves 36 of a prescribed width being formed between adjacent pumps to assure that the air within the hollow portion C is drawn into the pumps to the maximum possible extent. The air drawn into each pump 5 is delivered to the arch portion of the shoe by the ventilating tube 9 connected thereto.

The shoe of the present invention, having the foregoing construction and operating in the manner described, exhibits the following outstanding effects:

(1) As the weight of the wearer is alternatingly applied to and removed from the shoe, the inner sole is repeatedly pressed inwardly of the shoe to form a space between the shoe and the wearer's foot, allowing a large quantity of fresh air to enter the shoe. At the same time, the air within the hollow portion between the inner and outer soles at the front of the shoe is forced into the shoe through the ventilating holes in the inner sole, while the remaining air which has been drawn into the pumps is expelled toward the rear of the shoe through the ventilating tubes, and is exchanged with air entering from the outside of the shoe at the ankle portion thereof. Such ventilating action gives rise to the movement of a large quantity of air within the shoe. The effect is removal of moisture from the shoe to promote a sanitary condition therewithin.

(2) According to the present invention, air is constantly being moved within the space at the front end of the shoe, which air is both forced into the shoe and expelled toward the rear of the shoe for discharge to the outside. This prevents completely the accumulation of moist, stagnant air within the shoe.

(3) The shoe is very comfortable to wear since the pump body is received between the inner and outer soles and has been designed so as not to undergo local deformation.

As many apparently widely different embodiments of the present invention can be made without departing from the spirit and scope thereof, it is to be understood that the invention is not limited to the specific embodiments thereof except as defined in the appended claims.

What we claim is:

1. A shoe comprising an inner sole, an outer sole, said inner sole and outer sole delimiting a hollow portion having a marginal area of a predetermined height, hollow pumping means disposed along the marginal area of said hollow portion for drawing in and expelling air, first air flow-though means provided on said pumping means for communicating the interior and exterior of said pumping means, and second air flow-through means provided on said inner sole for communicating said hollow portion with the interior of the shoe, the compression and relaxation of said pumping means upon the application and removal of the wearer's weight causing the circulation of air particularly along the marginal area of said hollow portion between said inner sole and outer sole.

2. A shoe according to claim 1, further comprising a ventilating tube having one end thereof connect to the rear portion of the hollow pumping means and having the other end thereof extended to and opened at the arch portion of the shoe for discharging air, expelled from said pumping means, at least into the hollow portion formed between the inner sole and outer sole and communicated with the interior of the shoe through said second air flow-through means provided on said inner sole.

3. A shoe according to claim 1, further comprising a plurality of supporting bodies, consisting of a resilient material, provided together with the hollow pumping means in the hollow portion between the inner sole and outer sole, said supporting bodies being compressed and relaxed together with said pumping means upon the application and removal of the wearer's weight, thereby facilitating the circulation of air.

4. A shoe according to claim 3, in which said supporting bodies are disposed in the hollow portion in such a manner that a gap of prescribed dimensions is formed between the inner sole and the pumping means when said pumping means are in the relaxed state.

5. A shoe according to claim 3, in which each supporting body is a hollow member having air flow-through means.

6. A shoe according to claim 3, in which the supporting bodies and hollow pumping means are formed into a unitary structure.

7. A shoe according to claim 3, in which the supporting bodies are formed independently of the hollow pumping means.

8. A shoe according to claim 3, in which the supporting bodies resiliently support the inner sole and are so arranged along the perimeter of the hollow portion as to disperse the air residing in the marginal areas of the hollow portion upon being deformed by the application of the wearer's weight.

9. A shoe comprising an outer sole having an erect portion formed on the periphery thereof, an inner sole provided on said outer sole and having ventilating holes, said outer sole and inner sole delimiting a hollow portion therebetween, and hollow pumping means provided in said hollow portion and extending along a marginal area of said hollow portion, said pumping means having air intake holes arranged along said marginal area for drawing in air, and air discharge holes for expelling particularly such air as resides along the marginal area of said hollow portion, the air which resides in said marginal area, particularly at the front portion of the shoe, being circulated by the deformation of said erect portion and by the compression and relaxation of of said pumping means caused by the application and removal of the wearer's weight.

10. A shoe according to claim 9, in which the erect portion of the outer sole includes an inwardly projecting flange at the crown thereof, the inner sole being carried on said flange to facilitate the deformation of said erect portion when the wearer's weight is applied to said inner sole.

11. A shoe comprising an upper, an inner sole whose lower surface is adhered to said upper, an outer sole which delimits with said inner sole a hollow portion communicating pneumatically with the interior of the shoe, said inner sole being deformable into said hollow portion upon receiving the wearer's weight, and pumping means provided in said hollow portion for delivering the air residing in said hollow portion to the rear portion of the shoe upon being deformed by the application and removal of the wearer's weight, wherein, upon deformation of said inner sole under application of the wearer's weight, a gap is provided between the wearer's foot and the shoe upper, providing ventilation clearance for the exchange of air between said hollow portion and the interior of the shoe at the front portion thereof, and the air which resides in said hollow portion is discharged toward the rear of the shoe by said pumping means.

12. A shoe comprising an inner sole, an outer sole, said inner sole and outer sole delimiting a hollow portion at the front end of the shoe, a plurality of pumping members provided in said hollow portion for allowing the free movement of air between the hollow portion and the interior of the shoe, said pumping members having side walls containing a multiplicity of holes which close and open upon the application and removal respectively of the wearer's weight whereby said pumping members draw in the air from said hollow portion and compress said air, and means connecting said pumping members with the rear portion of the shoe for delivering the air compressed by said pumping members to said rear portion of the shoe.

13. A shoe according to claim 12, in which the inner sole which partitions the interior of the shoe from the hollow portion is provided with a plurality of randomly distributed ventillating holes.

14. A shoe according to claim 12, in which the holes provided in the side walls of the pumping members are elongated in a direction which crosses the direction from which the wearer's weight is applied.

* * * * *